United States Patent [19]

Harmalker

[11] Patent Number: 4,869,836

[45] Date of Patent: Sep. 26, 1989

[54] WASH CYCLE FABRIC CONDITIONING COMPOSITIONS: TERTIARYAMINE-MULTI-FUNCTIONAL CARBOXYLIC ACID COMPLEX

[75] Inventor: Subhash Harmalker, Somerset, N.J.

[73] Assignee: Colgate-Palmolive Co., Piscataway, N.J.

[21] Appl. No.: 189,560

[22] Filed: May 3, 1988

[51] Int. Cl.[4] ..... D06M 5/26

[52] U.S. Cl. ..... 252/8.8; 252/8.6; 8/137

[58] Field of Search ..... 8/137; 252/8.8

[56] References Cited

U.S. PATENT DOCUMENTS 4,237,155 12/1980 Karpdouche ..... 252/8.8
4,375,416 3/1983 Crisp et al. ..... 252/8.7
4,514,444 4/1985 Ives et al. ..... 252/8.6
4,698,167 10/1987 St. Laurent et al. ..... 252/8.8

FOREIGN PATENT DOCUMENTS 123400 10/1984 European Pat. Off. .

*Primary Examiner*—A. Lionel Clingman
*Attorney, Agent, or Firm*—Bernard Lieberman; Murray M. Grill; Robert C. Sullivan

[57] ABSTRACT

Fabric conditioning compositions which impart softness and antistatic properties are provided for through-the-wash use in conjunction with machine dryers. The fabric conditioning compositions comprise complexes of specified tertiary amines and multi-functional carboxylic acids in combination with unreacted amine, the latter being present in an amount of at least 20% of the stoichiometric amount of tertiary amine required to form the complex.

33 Claims, No Drawings

WASH CYCLE FABRIC CONDITIONING COMPOSITIONS: TERTIARYAMINE-MULTI-FUNCTIONAL CARBOXYLIC ACID COMPLEX

BACKGROUND OF THE INVENTION

This invention relates to novel through-the wash fabric conditioning compositions, their method of manufacture, and freeflowing base beads and aqueous liquid emulsions containing such compositions, which compositions provide softening and antistatic benefits to laundered fabrics without adversely affecting cleaning.

A large number of compositions have been disclosed which impart softening and antistatic properties to laundered fabrics. Generally, these contain cationic compounds, especially quaternary ammonium salts. Such compositions are widely marketed for home use in the form of emulsions which must be added to the washing machine during the rinse cycle. If the emulsions are added during the wash cycle the cationic fabric conditioners may interact with anionic surfactants present in the washing composition so as to render a portion of each of such cationic compound and anionic surfactant unavailable for either cleaning or fabric conditioning.

Another means of providing fabric conditioning which has attained some commercial success is to add the conditioning agent while the clothes are being machine dried.

While fabric conditioning during either the rinse and/or drying cycles can be effective, both methods of conditioning are more inconvenient than a through-the-wash method where the conditioning agent is added with the detergent composition at the initiation of the wash cycle.

Compositions are known which can be added to a washing machine at the start of the wash cycle and effectively provide fabrics with a detergency treatment during the wash cycle and a fabric conditioning treatment during either the rinsing operation or subsequently when the fabrics are heated in a machine dryer. Compositions of this type are known in the art as through-the-wash fabric conditioners. An important advantage of such compositions is that they obviate the need for adding a separate fabric conditioning product in the rinse cycle or in a machine dryer.

Through-the-wash type conditioning agents are well known in the art. European Patent Application No. 0,123,400, published Oct. 31, 1984 discloses fabric conditioning agents comprising salts of specified tertiary amines and carboxylic acids which are utilized in the form of nodules which pass virtually unchanged through the wash and rinse and condition the fabric when heated in a dryer. The nodules are meant to be added to the laundry wash liquor at the beginning of the wash cycle along with a conventional detergent. European Patent Publication No. 0,133,804 published Mar. 6, 1985 discloses detergent compositions containing clay fabric softeners and particles of a complex of a long chain amine and a fatty acid. U.S. Pat. No. 4,514,444 to Ives discloses a fabric cleaning/conditioning composition comprising carboxylic acid salts of a tertiary amine in combination with polyethylene glycol. U.S. Pat. No. 4,375,416 to Crisp et al discloses a textile softening detergent composition comprising a specified class of tertiary amines with a smectite-type clay in a detergent composition such that softening benefits are provided without impairing cleaning performance.

Other recent prior art relating to the field of the invention includes U.S. Pat. No. 4,237,155 to Kardouche which discloses a dryer-added fabric conditioning agent comprised of a carboxylic acid salt of a tertiary amine. British Patent No. 1,514,276 discloses the use of tertiary amine compositions as wash-cycle fabric softeners.

Complexes of specified tertiary amines and carboxylic acids have been previously disclosed as through-the-wash fabric conditioners in U.S. Ser. No. 884,156, filed July 10, 1986. While such complexes are able to provide effective softening and anti-static properties to fabrics in the presence of washing compositions without impairing cleaning, they nevertheless are not always able to provide the desired degree of fabric softening when in the presence of certain commercial surfactants in the wash water. Consequently, there remains a need in the art for a through-the-wash fabric conditioner which can provide fabrics with a high level of softening and anti-stat properties, and which is compatible with a wide variety of commercial laundry detergent compositions.

SUMMARY OF THE INVENTION

The present invention provides a fabric conditioning composition capable of imparting softness and anti-static properties to fabrics treated therewith in a laundry bath without adversely affecting fabric cleaning comprising (a) a fabric conditioning amount of a multi-functional carboxylic acid complex of a tertiary amine formed from the reaction of (1) a tertiary amine having the general formula:

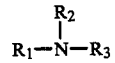

wherein $R_1$ is methyl or ethyl, and $R_2$ and $R_3$ are each independently an aliphatic group having from 12 to 22 carbon atoms, and (ii) a multi-functional carboxylic acid selected from the group consisting of citric acid, and di and tri carboxylic acids having from 21 to 54 carbon atoms; and (b) an effective amount of unreacted tertiary amine having the general formula defined above, said effective amount being at least 0.2 times the stoichiometric amount of tertiary amine required to form the multi-functional carboxylic acid complex of (a).

The most effective fabric conditioning compositions of the invention contain an amount of unreacted tertiary amine varying from about 0.3 to 6 times the stoichiometric amount of reacted amine in the complex, preferably from about 0.6 to 6 times the said stoichiometric amount. Where, for example, the multi-functional carboxylic acid selected to form the complex is citric acid, the stoichiometric amount of reacted amine in the complex is 3 moles of amine per mole of citric acid.

The term "complex" as used throughout the specification and claims refers to the reaction product of the above described tertiary amine and carboxylic acid, and characterizes such reaction product in terms of the primary constituent thereof which is a complex rather than a salt of the acid and amine. The basis of such characterization is explained hereinafter in the specification. Although the applicant does not wish to be limited by any theory regarding the nature of such reaction product, it is believed to be an equilibrium mixture comprised of the acid-amine complex (about 80%, by weight) and the acid-amine salt (about 20%, by weight). Accordingly, as used herein, the term "complex" includes both the acid-amine complex formed by the reaction of the tertiary amine and carboxylic acid as well as the relatively minor amount of salt in equilibrium therewith.

In accordance with a preferred embodiment of the invention, the fabric conditioning composition of the invention is supported upon a carrier such as free flowing porous base beads and advantageously used as an additive to the laundry bath in conjunction with a liquid or granular detergent composition. The porous base beads are conveniently comprised of from about 50 to 90%, by weight, of an inorganic or organic detergent builder salt, the balance comprising water and optionally adjuvants, such as perfume, colorants, brighteners and the like. Among the preferred inorganic builder salts for the porous base beads are the various phosphates, preferably polyphosphates, such as sodium tripolyphosphate. Carbonates, such as sodium carbonate are also useful builders and may be used separately or in mixture, such as in conjunction with sodium bicarbonate. Water insoluble builders, such as zeolites, may also be used for this purpose e.g. zeolite 4A.

The preparation of the porous base beads carrier may be conveniently effected by admixing the builder and other desired ingredients such as sodium silicate in an aqueous medium followed by drying such as spray drying using conventional slurry-making and spray-drying techniques used in the manufacture of detergent compositions.

In accordance with another preferred embodiment, the fabric conditioning composition of the invention is formulated to be a component of an aqueous liquid emulsion or suspension which may be conveniently added to the laundry bath during the wash cycle in conjunction with a liquid or granular detergent composition. A liquid emulsion of this type may have the following composition by weight to provide an effective and convenient wash-cycle additive product: (a) from about 5 to 30%, preferably about 10 to 20%, by weight of the above-defined fabric conditioning composition of the invention: (b) from about 0.1 to 10% of an emulsifying agent such as a suitable honionic detergent compound and (c) the balance water and adjuvants, if desired, such as perfumes, colorants, brighteners, foam stabilizers and the like and, optionally further including an anti-static composition distinct from the fabric conditioning composition of component (a) to enhance the anti-static properties of the wash-cycle additive liquid emulsion. A preferred additional anti-satic composition for this purpose is tallow neodecanamide.

In accordance with the process aspect of the invention, softness and anti-static properties are imparted to fabrics by contacting such fabrics in an aqueous medium with an effective amount of a fabric conditioning composition comprising (a) a fabric conditioning amount of a multifunctional carboxylic acid complex of a tertiary amine formed from the reaction of (i) a tertiary amine having the general formula:

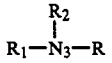

wherein $R_1$, is methyl or ethyl, and $R_2$ are each independently an aliphatic group having from 12 to 22 carbon atoms, and (ii) a multi-functional carboxylic acid selected from the group consisting of citric acid, and di and tri carboxylic acids having from 21 to 54 carbon atoms; and (b) an effective amount of unreacted tertiary amine having the general formula defined above, said effective amount being at least 0.2 times the stoichiometric amount of tertiary amine required to form the multifunctional carboxylic acid complex of (a).

The present invention is predicated on the discovery that the fabric conditioning compositions of the invention are compatible with nearly all common laundry detergent compositions, liquid or powder, such that they are capable of providing softness and anti-static properties to fabrics in a wash bath without adversely affecting fabric cleaning. The invention avoids the characteristic problem generally associated with the use of amine salts of dicarboxylic acids described in the prior art, namely, materials which provide anti-static properties but no softness or provide moderate softness with unacceptable anti-static properties. Moreover, unlike the fabric conditioning complexes disclosed in the aforementioned U.S. Ser. No.: 884,156, the present conditioning compositions ar capable of functioning effectively in the presence of a wide variety of surfactants commonly present in commercial laundry detergent compositions.

DETAILED DESCRIPTION OF THE INVENTION

The fabric conditioning compositions of the invention comprise complexes of a tertiary amine with a multi-functional carboxylic acid as herein defined. The suitable tertiary amines are represented by the general formula

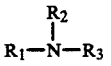

wherein $R_1$ is methyl or ethyl, and $R_2$ and $R_3$ are each independently an aliphatic group having from 12 to 22 carbon atoms. Examples of preferred amines include methyl distearyl amine, ethyl distearyl amine, methyl di(hydrogenated tallow) amine, ethyl di(hydrogenated tallow) amine, methyl diolelylamine, methyl dicoconut amine, methyl dilaurylamine, and methyl dipalm oil amine.

The multi-functional carboxylic acid utilized in the present invention is selected from among citric acid and di and tri carboxylic acids having 21 to 54 carbon atoms. Most preferred for use herein is citric acid. Among the other preferred acids are a dicarboxylic acid having 21 carbon atoms e.g. 5 (or 6)-carboxy-4 hexyl-2-cyclohexene-1-octanoic acid (sold commercially under the tradename Westvaco Diacid 1550 by Westvaco Corporation); dimerized oleic acid (sold commercially under the tradename Dimer Acid by Emery Industries); and a $C_{54}$ trimer of oleic acid.

The amine-multifunctional carboxylic acid complexes of the invention are generally prepared by forming a mixture of amine and multicarboxylic acid, preferably in a molar ratio of amine to carboxylic acid above that required for the stoichiometric reaction so as to provide the desired amount of unreacted amine in the reaction product, and heating such mixture to a temperature sufficient to form a melt.

For the example of a tertiary amine having a melting point below that of the carboxylic acid, preparation is conveniently effected by first heating the amine to its melting point (generally about 35 to 45 C.) and then adding thereto the multicarboxylic acid, such as for example citric acid, in the form of a solid. The resulting mixture is then heated to a temperature below the melting point of the carboxylic acid, but sufficient to form a molten mixture. In the case of citric acid, heating the reactant to a temperature of about 115 C. for about five to ten minutes will form a molten mixture having a melting point (about 50 C.) intermediate of the citric acid and the amine. The molten mixture comprises the reaction product of amine-multicarboxylic acid complex in equilibrium with a minor amount of amine-carboxylic acid salt.

In an alternate embodiment, the amine and carboxylic acid are reacted in a stoichiometric ratio to form the complex followed by the addition of unreacted tertiary amine to the resulting reaction product. This embodiment is particularly advantageous where it is desired to employ an unreacted amine in the fabric condition composition which is different from the reacted amine. This may desirable in some instances for purposes of economy.

The determination of the nature of the reaction product can be illustrated in terms of the reaction between methyl di(hydrognated tallow) amine and dimerized oleic acid which were mixed and heated following the general procedure described above except that in this instance the amine having a melting point above the carboxylic acid is added in solid form to dimerized oleic acid which is liquid at ambient temperature. The resulting reaction product was identified as a weak hydrogen bonded complex (80 wt. %) in equilibrium with the corresponding salt (20 wt. %). Identification was based on measurements involving melting points and spectroscopic techniques. The complex melted at 28 to 31 C. which is intermediate between the melting point of the amine (34 to 38 C.) and the carboxylic acid (4 to 5 C.). This indicates the formation of a complex rather than an amine salt, the latter being characterized by a sharp melting point higher than the corresponding amine.

The Infra red spectrum of the complex shows the presence of two moderate carbonyl bands at wavelengths of 1709 $cm^{-1}$ and 1550 $cm^{-1}$. The 935 $cm^{-1}$ wavelength indicative of H-bonding of the particular free carboxylic acid is absent, indicating the presence of a complex rather than salt formation. By means of ESCA (Election Spectroscopy for Chemical Analysis) measurements, it was determined that the reaction product was about 20% amine salt and 80% of the amine-carboxylic acid complex. The chemical shift of the ionic nitrogen of the salt was different than that of the neutral nitrogen of the complex. The relative amounts of these two nitrogen signals provide the basis for determining the relative amount of amine salt versus amine complex.

The fabric conditioning compositions of the invention may be advantageously added to a laundry bath or to the rinse liquor supported upon a carrier independent of any detergent, or such conditioning composition may be incorporated into a fully formulated detergent composition as a component thereof. When used as a laundry bath or rinse cycle additive, the fabric conditioning composition is preferably applied to free-flowing porous base beads comprised of about 50 to 90%, more preferably, 65 to 85%, by weight, of an inorganic or organic detergent builder salt, such as pentasodium tripolyphosphate, or water softening aluminum silicate, namely, a zeolite. The balance of the base beads is essentially comprised of water and may contain 5 to 15%, by weight, of sodium silicate, and optionally adjuvants such as dyes or processing aids such as polyacrylate.

The zeolite used in the base beads is usually synthetic and it is often characterized by having a network of substantially uniformly sized pores in the range of about 3 to 10 Angstroms, often being about 4A (normal), such size being uniquely determined by the unit structure of the zeolite crystal. Preferably it is of type A or similar structure, particularly described at page 133 of the text "Zeolite Molecular Sieves" by Donald Breck, published in 1974 by John Wiley & Sons. Good results have been obtained when a Type 4A molecular sieve zeolite is employed wherein the univalent cation of the zeolite is sodium and the pore size of the zeolite is about 4 Angstroms. Such Zeolite molecular sieves are described in U.S. Pat. Nos. 2,882,243 and 3,114,603. The zeolite may be amorphous or crystalline and have water of hydration as known in the art.

When applied to porous base beads as a carrier, the compositions of the inventions may comprise from about 5 to about 50%, by weight based on the total weight of the carrier plus fabric conditioning composition, preferably from about 10 to 40% by weight, and most preferably from about 15 to 35%, by weight. At concentrations of the composition above about 40%, by weight, the flowability of the resultant base beads may be adversely affected.

In accordance with a preferred embodiment of the invention, the fabric conditioning composition is formulated to be a component of an aqueous liquid emulsion which may be advantageously added to the laundry bath or to the rinse liquor independent of any laundry detergent composition or may conveniently be added to the laundry bath during the wash cycle in conjunction with a liquid or granular detergent composition.

The method of preparation of the aqueous emulsion containing the composition of the invention is predicated upon forming an emulsion or suspension which is stable over a practical range of temperatures, and particularly at high temperature, namely, it does not undergo phase separation at temperatures up to about 120 F., and in, addition, the particles of fabric conditioning composition which comprise the dispersed phase of the emulsion must be of the requisite size to deposit on washed fabrics during the wash cycle. It has been discovered that when present in an emulsion at particle sizes having a median diameter above about 10 microns, preferably from about 40 to 100 microns, the composition of the invention is capable of providing effective softening and anti-stat properties to washed fabrics whereas at particles sizes below such value fabric conditioning is often adversely affected. Although the applicant does not wish to be bound by any theory, it is believed that sufficiently large particle sizes of above about 10 microns are required to effect deposition of said particles on fabrics in the wash or rinse water.

High temperature stability and the avoidance of phase separation is achieved by regulating the HLB (hydrophilic-lipophilic balance) value of the emulsion to within the predetermined range required for stability by the addition of suitable emulsifying agents. The required range of HLB is readily determined by trial and error for each particular combination of tertiary amine and carboxylic acid utilized in the composition of the invention. For the particular instance where citric acid and methyl di(hydrogenated tallow) methyl amine are used to form the fabric conditioning composition, the HLB of the emulsion must be from about 11.5 to 12.5 to achieve the desired high temperature stability.

The liquid emulsion compositions preferably contain from about 5 to about 30%, and most preferably from about 7 to about 20% of the fabric conditioning composition of the invention, based on the total weight of the emulsion composition. At such concentrations, an effective amount of fabric conditioning composition is provided to the wash fabrics when dispensing an amount of the liquid emulsion to the wash or rinse cycle of an automatic washing machine comparable to the amounts added by users of commercial liquid fabric conditioners.

Nonionic surfactants are among the preferred emulsifying agents for preparing an emulsion in accordance with the invention having the desired stability, viscosity and particle size of fabric conditioning composition in the dispersed phase. Among the useful emulsifying agents ar Neodol 25-3 (an ethoxylated alcohol sold by Shell Chemical Company comprising a fatty alcohol averaging about 12 to 15 carbon atoms with about 3 moles of ethylene oxide per mole of alcohol); Neodol 25-12; and Neodol 45-13. Neodol 25-3 and 45-13 are particularly preferred for this purpose.

The preparation of the emulsion is conveniently effected in three stages: in the first stage the fabric conditioning composition, preferably at a temperature above its melting point, is added to an aqueous liquid, preferably water, along with a first portion of an emulsifying agent, such first portion being an amount selected to form upon mixing with the fabric conditioning composition particles of emulsified fabric conditioning composition having a median diameter above about 10 microns. The order of addition of the fabric conditioning composition and the first portion of emulsifying agent is not critical. It is preferred that the aqueous liquid be preheated to a temperature corresponding to at least the melting point of the fabric conditioning composition if the latter is introduced as a liquid. This is to insure that the emulsified particles formed in the first stage are in liquid form. In an alternate embodiment, the fabric conditioning composition is introduced into the aqueous liquid as a solid, following which the liquid is heated to a temperature sufficiently above the melting point of the conditioning composition such that upon mixing the conditioning composition with the first portion of emulsifying agent, there is provided an emulsion containing as the dispersed phase liquid particles of fabric conditioning composition having the desired particle size.

In the second stage the resulting emulsion is cooled to a temperature sufficiently below the melting point of the fabric conditioning composition so as to at least partially solidify the emulsified particles and form a suspension of solid particles in the aqueous liquid.

In the third stage, a second portion of one or more emulsifying agents is added to the emulsion or suspension formed in the second stage so as to adjust the HLB value to that required for high temperature stability. As defined herein, the characterization of "high temperature stability" for a liquid emulsion in accordance with the invention refers to its being able to be maintained at 120 F. for at least 24 hours without the occurrence of phase separation. After the formation of the emulsion in the third stage, electrolytes such as calcium chloride dihydrate, or sodium chloride may be added as viscosity modifiers, if needed, as well as defoaming materials to enhance proper mixing of the components by inhibiting phase separation resulting from foam agitation. Other optional components include colorants and perfume which are advantageously added sequentially under agitation.

The emulsified particles in the dispersed phase of the emulsion are not all of uniform size and comprise a broad distribution of particle sizes, but it is required that the median diameter of such particles be above 10 microns. A preferred particle size is that having a mean diameter of from about 40 to 100 microns. Measurement of the emulsified particles is most conveniently carried out at the end of the third stage when the final emulsion is formed rather than at the end of the first stage where the relatively strong association of the emulsified particles may make the particle size measurement somewhat less accurate.

The aforementioned three-stage method of preparation is predicated upon utilizing a fabric conditioning composition having a melting point above ambient temperature such that in the first stage of preparation only a limited amount of emulsifying agent is added to provide the desired size of emulsified particles as a dispersed liquid phase. Thereafter upon cooling, the dispersed particles solidify, allowing additional amounts of emulsifying agent to be added to the emulsion without causing any diminution in particle size. Thus, the HLB of the emulsion can be independently adjusted to the desired range without affecting the size of the particles in the dispersed phase.

A fully formulated detergent composition containing an effective amount of a fabric conditioning composition in accordance with the invention is capable of proving effective cleaning and softening concomitant with imparting anti-static properties to the laundered fabrics. The fabric conditioning composition may be present in such fully formulated detergent compositions in an amount of from about 0.5 to 15% preferably from about 3 to 10%, based on the total weight of the composition. The fabric conditioning composition may be present in such fully formulated detergent compositions in an amount of from about 0.5 to 15% preferably from about 3 to 10%, based on the total weight of the composition.

A suitable detergent and conditioning composition should accordingly contain:

(a) from about 5 to 50%, by weight, of at least one detergent compound:

(b) from about 5 to 75%, by weight, of an organic or organic detergent builder;

(c) from about 0.5 to 15%, by weight, of a fabric conditioning composition comprising:

(A) a fabric conditioning amount of a multicarboxylic acid complex of a tertiary amine formed from the reaction of (1) a tertiary amine having the general formula:

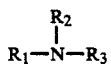

wherein $R_1$ is methyl or ethyl, and $R_2$ and $R_3$ are each independently an aliphatic group having from 12 to 22 carbon atoms, and (ii) a multi-functional carboxylic acid selected from the group consisting of citric acid, and di and tri carboxylic acids having from 21 to 54 carbon atoms; and (B) an effective amount of unreacted tertiary amine having the general formula defined above, said effective amount being at least 0.3 times the stoichiometric amount of tertiary amine required to form the multi-functional carboxylic acid complex of (A).

(d) the balance water and optionally a filler salt

A preferred detergent and conditioning composition, in accordance with the invention contains from about 10 to 20%, by weight, of an anionic detergent compound and from about 20 to 40% of a detergent builder. In accordance with another embodiment, the detergent composition contains from about 15 to 25%, by weight, of a nonionic detergent compound and from about 40 to 60% of a detergent builder.

Various anionic detergents, usually as sodium salts, may be employed but those which are most preferred are linear higher alkyl benzene sulfonates, higher alkyl sulfates and higher fatty alcohol polyethoxylate sulfates. Preferably, in the higher alkyl benzene sulfonate the higher alkyl is linear and of 12 to 15 carbon atoms, e.g., 12 or 13, and is a sodium salt. The alkyl sulfate is preferably a higher fatty alkyl sulfate of 10 to 18 carbon atoms, preferably 12 to 16 carbon atoms, e.g., 12 and is also employed as the sodium salt. The higher alkyl ethoxamer sulfates will similarly be of 10 to 12 to 18 carbon atoms, e.g., 12, in the higher alkyl, which will preferably be a fatty alkyl, and the ethoxy content will normally be from 3 to 30 ethoxy groups per mole, preferably 3 or 5 to 20. Again, the sodium salts are preferred. Thus, it will be seen that the alkyls are preferably linear or fatty higher alkyls of 10 to 18 carbon atoms, the cation is preferably sodium, and when a polyethoxy chain is present the sulfate is at the end thereof. Other useful anionic detergents of this sulfonate and sulfate group include the higher olefin sulfonates and paraffin sulfonates, e.g., the sodium salts wherein the olefin or paraffin groups are 10 to 18 carbon atoms. Specific examples of the preferred detergents are sodium linear dodecylbenzene sulfonate, sodium tridecylbenzene sulfonate, sodium tallow alcohol polyethoxy (3 E0) sulfate, and sodium hydrogenated tallow alcohol sulfate. In addition to the preferred anionic detergents mentioned, others of this well known group may also be present, especially in only minor proportions with respect to those previously described. Also, mixtures thereof may be employed and in some cases such mixtures can be superior to single detergents. The various anionic detergents are well known in the art and are described at length at pages 25 to 138 of the text "Surface Active Agents and Detergents", Vol. II, by Schwartz, Perry and Berch, published in 1958 by Interscience Publishers, Inc.

Small proportions of fatty acid soaps, e.g., sodium soaps of fatty acids of 10 to 22 carbon atoms, preferably 14 to 18 carbon atoms, e.g., sodium hydrogenated tallow fatty acids soaps, can be employed, when less foam in the washing machine is desirable.

Nonionic detergents of satisfactory physical characteristics may be utilized in place of or with anionic detergents, including condensation products of ethylene oxide and propylene oxide with each other and with hydroxyl-containing bases, such as nonyl phenol and Oxotype alcohols. It is highly preferred that the nonionic detergent be a condensation product of ethylene oxide and higher fatty alcohol. In such products the higher alcohol is of 10 to 20 carbon atoms, preferably 12 to 16 carbon atoms, and the nonionic detergent contains from about 3 to 20 or 30 ethylene oxide groups per mole, preferably from 6 to 12. Most preferably, the nonionic detergent will be one in which the higher fatty alcohol is of about 12 to 13 or 15 carbon atoms and which contains from 6 to 7 or 11 moles of ethylene oxide. Such detergents are made by Shell Chemical Company and are available under the trade name Neodol 23-6.5 and 25-7, the latter being a condensation product of a mixture of higher fatty alcohols averaging about 12 to 15 carbon atoms and the number of ethylene oxide groups per mole averages about 7. Among their especially attractive properties, in addition to good detergency with respect to oily stains on fabrics to be washed, is a comparatively low melting point, which is still appreciably above room temperature, so that they may be sprayed onto spray dried base beads as a liquid which solidifies.

Ampholytic detergents are also suitable for the invention. Ampholytic detergents are well known in the art and many operable detergents of the class are disclosed by Schwartz, Perry and Berch in the aforementioned "Surface Active Agents and Detergents". Example of suitable amphoteric detergents include: alkyl betaiminodipropionates, $RN(Chd\ 2H_4COOM)_2$; alkyl beta-amino propionates, $RN(H)C_2H_4COOM$; and long chain imidazole derivatives having the general formula

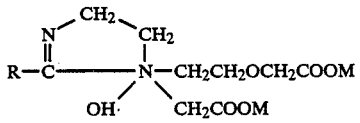

wherein in each of the above formulae R represents an acyclic hydrophobic group containing from about 8 to 18 carbon atoms and M is a cation to neutralize the charge of the anion. Specific operable amphoteric detergents include the disodium salt of undecylcycloimidinum-ethoxyethionic acid-2-ethionic acid, dodecyl beta alanine, and the inner salt of 2-trimethylamino lauric acid.

The amounts of the zwitterionic synthetic organic detergent and the ampholytic synthetic organic detergent when present in the invention composition are not particularly critical and can be selected depending on the desired results. Generally, either or both of these classes of detergent ingredients can be used to replace all or part of the anionic organic detergent surfactant and/or nonionic organic detergent surfactant within the ranges disclosed above.

The detergent compositions of the invention optionally, but preferably, contain at least one detergent builder of the type commonly used in detergent formulations. Useful builders include any of the conventional inorganic water-soluble builder salts, such as, for example, water-soluble salts of phosphates, pyrophosphates, orthophosphates, polyphosphates, silicates, carbonates, bicarbonates, borates, sulfates, and the like. Organic builders include water-soluble phosphates, polyphosphonates, polyhydroxysulphonates, polyacetates, aminopolyacetates, carboxylates, polycarboxylates, succinates, and the like.

Specific examples of inorganic phosphate builders include sodium and potassium tripolyphosphates, pyrophosphates and hexametaphosphates. The organic polyphosphonates specifically include, for example, the sodium and potassium salts of ethane 1-hydroxy-1, 1-diphosphonic acid and the sodium and potassium salts of ethane-1, 1,2-triphosphonic acid. Example of these and other phosphorous builder compounds are disclosed in U.S. Pat. Nos. 4,225,452; 3,213,030; 2,422,021; 3,422,137 and 3,400,176. Pentasodium tripolyphosphate and tetrasodium pyrophosphate are especially preferred water-soluble inorganic builders.

Speciic examples of non-phosphorous inorganic builders include water-soluble inorganic carbonate, bicarbonate and silicate salts. The alkali metal, for example, sodium and potassium, carbonates, bicarbonates and silicates are particularly useful herein.

Water-soluble organic builders are also useful. For example, the alkali metal, ammonium and substituted ammonium acetates, carboxylates, polycarboxylates and polyhydroxysulphonates are useful builders for the compositions and processes of the present invention. Specific examples of acetate and polycarboxylate builders include sodium, potassium, lithium, ammonium and substituted ammonium salts of ethylene diaminetetracetic acid, nitrilotriacetic acid, benzene polycarboxylic (i.e. penta- and tetra-) acids, carboxymethoxysuccinic acid and citric acid.

Additional organic builder salts useful herein include the polycarboxylic materials described in U.S. Pat. No. 2,264,103, including the water-soluble alkali metal salts of mellitic acid. The water-soluble salts of polycarboxylate polymers and copolymers such as are described in U.S. Pat. No. 3,308,067, are also suitable herein.

Water-insoluble builders may also be used, particularly, the complex sodium alumino silicates such as, zeolites, e.g., zeolite 4A, a type of zeolite described hereinabove.

The builder salts, including both the inorganic and organic detergent builder salts are conveniently employed so as to provide in the finished composition, after mixing with the post-added ingredients, from about 5 to 75%, preferably about 20 to 60%, of detergent builder salts(s), based on the total composition.

Various adjuvants may be included in the fully formulated detergent and conditioning composition of the invention as well as in the support (e.g. porous base beads) upon which fabric conditioning compositions are adsorbed and/or absorbed. In general, these include perfume; colorants, e.g., pigments and dyes; bleaches, such as, sodium perborate; bleach activators; antiredeposition agents, such as, alkali metal salts of carboxymethyl-cellulose; optical brighteners, such as, anionic, cationic or nonionic brighteners; foam stabilizers, such as alkanolamides; enzymes; and the like, all of which are well-known in the fabric washing art for use in detergent compositions. Flow promoting agents, commonly referred to as flow aids, may also be employed to maintain the particulate compositions as free-flowing beads or powder. Starch derivatives and special clays are commercially available as additives which enhance the flowability of otherwise tacky or pasty particulate compositions, two of such clay additives being presently marketed under the tradenames "Satintone" and "Microsil". The adjuvants are, of course, selected to be compatible with the main constituents of the composition.

EXAMPLE I

A commercial granular detergent composition designated herein as Control "A" was used in the following examples and had the following composition:

| Control A | |
|---|---|
| Component | Weight Percent |
| Linear alkylbenzene sulfonate | 4 |
| Sodium fatty alcohol sulfate | 9 |
| Sodium ethoxy alcohol sulfate | 3 |
| Polyethoxylated alcohol | 0.7 |
| Pentasodium tripolyphosphate | 31 |
| Sodium pyrophosphate | 7 |
| Sodium carbonate | 9 |
| Sodium sulfate | 16 |
| Sodium silicate | 5 |
| Moisture and adjuvants | Balance |

The following washing procedure was used to evaluate the efficacy of the various compositions set forth in Examples 1–5. Each of the various compositions described in Examples 2 to 5, in the amounts indicated in said examples, were added along with 86 grams of Control A to a U.S. top-loading washing machine. A 6½ lb ballast wash load comprised of cotton and synthetic fabrics was washed with 64 liters of water at 90 F. using a fourteen minute wash cycle with rinse and spin operations followed by drying for one hour in an electric dryer. The washing and drying steps were then repeated and following the second drying operation the fabrics were evaluated for their anti-static properties by visual inspection. The terry towels in each wash load were then equilibrated to 40% humidity overnight and the following day were evaluated for softness by a six member panel. The results of the static and softness evaluation for each of the tested compositions is described in Table 1.

EXAMPLE 2

For purposes of comparing the compositions of the invention to fabric conditioning compositions of the prior art, an aqueous amine fabric-softening, dispersion was prepared in accordance with GB patent No. 1,514,276. To a solution of sodium stearate in 55 g water there was added 10 grams of molten methyl di(hydrogenated tallow) amine (sold commercially as Armcen M2HT by Akzo Chemicals Incorporated) and the mixture stirred and subjected to ultrasonic dispersion until it was homogeneous. The resulting product was used when fresh; if allowed to stand overnight it separated into a solid and liquid phase.

The amount of this dispersion used per wash load was 65 grams. The fabric conditioning achieved is shown in Table 1.

EXAMPLE 3

A granular amine/citrate complex was prepared by forming a melt of methyl di(hydrogenated tallow) amine and anhydrous citric acid in a stoichiometric mole ratio of 3:1 at 115 C. Ten grams of the resulting complex was sprayed in a rotating drum on to 30 grams of free-flowing porous base beads to provide 40 grams of product.

The porous base beads were prepared by spray drying an aqueous mixture of potassium tripolyphosphate (TPP), and had the following composition.

| Porous Base Beads | Weight Percent |
|---|---|
| TPP | 80.7 |
| Silicate | 3.8 |
| Brightener | 1.3 |
| Moisture and adjuvants | Balance |

The surface of the base beads was neutralized by overspraying with 50% citric acid solution in an amount of 5.8%, by weight of the base beads.

The fabric conditioning achieved using 40 grams of product per wash load is shown in Table 1.

EXAMPLE 4

A fabric conditioning composition in accordance with the invention was prepared by adding citric acid to methyl di(hydrogenated tallow) amine, the mixture being heated at 115 F. for about 15 minutes to form a molten mixture thereof. The amine and citric acid were added in a mole ratio of 11 to 1 (weight ratio of 30.2 to 1), 8 moles of amine being present in the resulting mixture as unreacted amine per mole of complex. The melting point of the composition was about 50 C., the solid resembling a wax-like material.

The liquid fabric conditioning composition was heated to above 50 C and then sprayed into a rotating drum containing the porous base beads described in Example 3. The resulting granular composition comprised the following:

| Component | Weight Percent |
|---|---|
| Fabric Conditioning Composition | 23.7% |
| Base Beads | 75.2 |
| Perfume | 1.0 |

The fabric conditioning achieved with this granular composition using 40 grams per wash load is shown in Table 1.

EXAMPLE 5

A liquid emulsion in accordance with the invention was prepared as follows: To 70.5 grams of deionized water maintained at a constant temperature of 50 C. there was added while mixing 0.2 grams of Neodol 45-13 as cmulsifying agent (a tradename for a Shell Chemical Company detergent which is a condensation product of a mixture of fatty alcohols averaging about 14 to 15 carbon atoms with about 13 moles of ethylene oxide per mole of alcohol). This was followed by the addition of 11.9 grams of fabric conditioning composition in liquid form to the aqueous medium. The liquid conditioning composition was prepared as described in Example 4 except that the tertiary amine and citric acid reactants were present in a molar ratio of 5.2 to 1 (weight ratio of 14.3 to 1). The fabric conditioning composition at a temperature of 60 C. was added slowly to the aqueous liquid under gentle agitation. The resulting emulsion or suspension was then cooled to 25 C. forming a dispersed phase of solidified particles of the fabric conditioning composition in water, the emulsion having a cream-like consistency.

The particle size of the dispersed phase as determined by a HIAC/ROKO Particle Size Analyser (Model PA 720) marketed by Pacific Scientific Company was about 40 to 60 microns mean diameter. Such Analyzer uses established light blockage principles for measuring the particle size mean diameter whereby the measured particles interrupt a continuous light beam when passing through a sensing zone which, in turn, causes a reduction in the amount of light reaching a photo detector. This technique is particularly advantageous for measuring particle sizes larger than the normal range of particles conventionally measured by light scattering techniques.

Thereafter 1.1 grams of Neodol 25-3 was added to the emulsion followed by the addition under agitation of a separately prepared mixture of 1.7 grams of Neodol 45-13 in 13.8 grams of water. The latter mixture was prepared by dissolving the Neodol surfactant in warm water and then allowing the mixture to cool to room temperature before adding it to the emulsion. The HLB of the emulsion following addition of these two emulsifying agents was about 12.

A commercial defoaming material (0.02 grams) was then added to the resulting emulsion followed by the addition of adjuvants such as perfume (0.5 grams) and dye (0.02 grams), all while mixing. A minor amount of calcium chloride dihydrate (0.1 grams) and glycerine (0.5 grams) was then added to modify the viscosity followed by the addition of hexadecane (0.2 grams) to improve the pourability of the emulsion from its container.

The resulting emulsion was highly stable over a temperature range from ambient to at least 110 F., and, in particular, did not manifest any phase separation when aged at high temperature, namely, a minimum of 24 hours at a temperature of 110 F. or above.

The amount of liquid emulsion used per wash load was 90 grams, and the fabric conditioning results are shown in Table I.

TABLE 1

PERFORMANCE OF FABRIC CONDITIONING COMPOSITIONS OF THE INVENTION

| Formulation | ΔSoftness (a) | Static |
|---|---|---|
| Control A | — | Very heavy |
| Control A + prior art amine dispersion (Example 2) | <1 | Very heavy |
| Control A + amine/citrate complex (Example 3) | <1 | Very light |
| Control A + composition of invention on granular support (Example 4) | 4 | none |
| Control A + composition of invention in liquid emulsion (Example 5) | 3 | none to very light |
| conditions: wash cycle, 90 F for 14 minutes; base composition: 84 g of Control A | | |

(a) Softness: difference in softness measured is based on a scale of 1 (very harsh) to 10 (very soft) relative to control A as evaluated by a six-member panel. A difference of greater than one unit is considered significant. Control A provided a softness of from 3 to 4 when evaluated, on an absolute basis, on a scale of 1 to 10.

As noted in Table 1, the prior art amine dispersion (Example 2) and the amine/citrate complex in the absence of unreacted tertiary amine (Example 3) failed to provide superior softening relative to the use of the base composition, Control A. The compositions of the invention, (Examples 4 and 5), on the other hand, provided a significant improvement in softness to the washed fabrics as well as an almost complete elimination of observable static.

What is claimed is:

1. A fabric conditioning composition capable of imparting softness and anti-static properties to fabrics treated therewith in a laundry bath without adversely affecting fabric cleaning comprising (a) a fabric conditioning amount of a multi-functional carboxylic acid complex of a tertiary amine formed from the reaction of (i) a tertiary amine having the general formula:

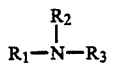

wherein $R_1$ is methyl or ethyl, and $R_2$ and $R_3$ are each independently an aliphatic group having from 12 to 22 carbon atoms, and (ii) a multi-functional carboxylic acid selected from the group consisting of citric acid, and di and tri carboxylic acids having from 21 to 54 carbon atoms; and (b) an effective amount of unreacted tertiary amine having the general formula defined above, said effective amount being at least 0.2 times the stoichiometric amount of tertiary amine required to form the multi-functional carboxylic acid complex of (a).

2. A fabric conditioning composition according to claim 1 wherein the tertiary amine is methyl distearyl amine.

3. A fabric conditioning composition according to claim 1 wherein the amine is methyl di (hydrogenated tallow) amine.

4. A fabric conditioning composition according to claim 1 wherein $R_2$ and $R_3$ are each an alkyl group.

5. A fabric conditioning composition according to claim 1 wherein the multifunctional carboxylic acid is citric acid.

6. A fabric conditioning composition according to claim 1 wherein said effective amount is about 0.3 to 6 times the stoichiometric amount of tertiary amine reacted to form said complex.

7. A fabric conditioning composition according to claim 1 which is adsorbed and/or absorbed upon free-flowing porous base beads which comprise by weight from about 50 to 90% of an inorganic or organic detergent builder, the balance comprising water and adjuvants.

8. A fabric conditioning composition according to claim 7 wherein said base beads comprise by weight from about 50 to 90% pentasodium tripolyphosphate.

9. A fabric conditioning composition according to claim 7 wherein said base beads comprise by weight from about 50 to 90% of water softening aluminum silicate.

10. A fabric conditioning composition according to claim 7 wherein said fabric conditioning composition is from about 5 to 50%, of the total weight of said conditioning composition and said base beads.

11. A wash-cycle or rinse cycle additive aqueous liquid emulsion for providing softness and anti-static properties to fabrics treated therewith in a laundry bath comprising:

(a) from about 5 to 30%, by weight, of a fabric conditioning composition according to claim 1;

(b) from about 0.1 to 10%, by weight, of one or more emulsifying agents; and (c) the balance water and optionally a compound for providing anti-static properties additional to that provided by said fabric conditioning composition.

12. A detergent and conditioning composition capable of cleaning softening and imparting anti-static properties to fabrics treated therewith in a laundry bath comprising:

(a) from about 5 to 50%, by weight, of at least one detergent compound;

(b) from about 5 to 75%, by weight, of an inorganic or organic detergent builder;

(c) from about 0.5 to 15%, by weight, of a fabric conditioning composition in accordance with claim 1; and (d) the balance water and optionally a filler salt.

13. A detergent and conditioning composition according to claim 12 wherein the fabric conditioning composition is present in an amount of from about 3 to about 9 percent.

14. A detergent and conditioning composition according to claim 12 which contains from about 10 to 20% sodium alkyl benzene sulfonate, and from about 20 to 30% pentasodium tripolyphosphate.

15. A detergent and cleaning composition according to claim 12 which contains from about 13 to 23% of a nonionic detergent compound, and from about 50 to 60% of pentasodium tripolyphosphate.

16. A detergent and cleaning composition according to claim 12 wherein the unreacted tertiary amine in said fabric conditioning composition is present in amount of from about 0.3 to 6 times the stoichiometric amount of tertiary amine reacted to form said complex.

17. A detergent and cleaning composition according to claim 12 wherein the tertiary amine in said fabric conditioning composition is methyl di (hydrogenated tallow) amine.

18. A detergent and cleaning composition according to claim 12 wherein the multi-functional carboxylic acid in said fabric conditioning composition is citric acid.

19. A detergent and cleaning composition according to claim 12 wherein the multi-functional carboxylic acid in said fabric conditioning composition is dimerized oleic acid.

20. A process for preparing a stable wash cycle or rinse cycle-additive liquid emulsion containing as the dispersed phase thereof the fabric conditioning composition of claim 1 for providing softness and anti-static properties to fabrics treated therewith in a laundry bath comprising the steps of:

(a) introducing into an aqueous liquid (i) an effective amount of the fabric conditioning composition of claim 1 and (ii) a first portion of an emulsifying agent, said first portion being an amount selected to form upon mixing in liquid form with said effective amount of fabric conditioning composition, emulsified particles of the said fabric conditioning composition having a median diameter greater than about 10 microns;

(b) heating said aqueous liquid prior to or subsequent to step (a) to a temperature corresponding to at least the melting point of said fabric conditioning composition such that upon mixing said effective amount of fabric conditioning composition and said first portion of emulsifying agent there is provided an emulsion containing liquid particles of said fabric conditioning composition as the dispersed phase;

(c) cooling the resulting emulsion to a temperature sufficiently below the melting point of said fabric conditioning composition to at least partially solidify said emulsified particles of fabric conditioning composition; and (d) introducing into the emulsion formed in step (c) a second portion of one or more emulsifying agents to adjust the HLB value of the emulsion to that required for providing high-temperature stability.

21. A process in accordance with claim 20 wherein prior to step (a) said aqueous liquid is heated to temperature corresponding to at least the melting point of said fabric conditioning composition.

22. A process in accordance with claim 21 wherein in step (a) said fabric conditioning composition is introduced into the aqueous liquid at a temperature above its melting point.

23. A process in accordance with claim 20 wherein in step (a) said fabric conditioning composition is introduced into the aqueous liquid at a temperature below its melting point and wherein subsequent to step (a) said aqueous liquid is heated to a temperature sufficiently above the melting point of the fabric conditioning composition so as to form upon mixing an emulsion in accordance with step (b).

24. A process in accordance with claim 20 wherein the tertiary amine in said fabric conditioning composition is methyl di(hydrogenated) tallow amine.

25. A process in accordance with claim 20 wherein the multifunctional carboxylic acid in said fabric conditioning composition is citric acid.

26. A process in accordance with claim 20 wherein the amount of unreacted tertiary amine in said fabric conditioning composition is from about 0.3 to 3 times the stoichiometric amount of amine reacted to form the complex.

27. A process in accordance with claim 20 wherein said effective amount is from about 5 to 30%, by weight, of said liquid emulsion.

28. A process in accordance with claim 20 further including the step of introducing a viscosity modifier and optionally other adjuvants into said aqueous liquid.

29. A process in accordance with claim 20 wherein in step (a) said fabric conditioning composition and said first portion of emulsifying agent are introduced sequentially into said aqueous liquid.

30. A process in accordance with claim 20 wherein in step (a) the emulsified particles of fabric conditioning composition have a median diameter of from about 40 to 100 microns.

31. A process for imparting softness and anti-static properties to fabrics comprising the step of contacting the fabrics in a laundry wash or rinse liquor with an effective amount of a fabric conditioning composition comprising (a) a fabric conditioning amount of a multi-functional carboxylic acid complex of a tertiary amine formed from the reaction of (i) a tertiary amine having the general formula:

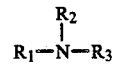

wherein $R_1$ is methyl or ethyl, and $R_2$ and $R_3$ are each independently an aliphatic group having from 12 to 22 carbon atoms, and (ii) a multi-functional carboxylic acid selected from the group consisting of citric acid, and di and tri carboxylic acids having 21 to 54 carbon atoms; and (b) unreacted tertiary amine having the general formula defined above, said unreacted amine being present in an amount of at least 0.2 times the stoichiometric amount of tertiary amine required to form the multi-functional carboxylic acid complex of (a).

32. A process in accordance with claim 31 wherein the multifunctional carboxylic acid is citric acid.

33. A process in accordance with claim 31 wherein the tertiary amine is methyl di(hydrogenated tallow) amine.

* * * * *